US005639022A

United States Patent [19]

Yanta et al.

[11] Patent Number: 5,639,022

[45] Date of Patent: Jun. 17, 1997

[54] SUPERSONIC FLUID DISPERSING INJECTOR

[75] Inventors: William J. Yanta, Beltsville, Md.; Christopher K. Williams, Massillon, Ohio

[73] Assignee: The United States of America as represented by the Secretary of the Navy, Washington, D.C.

[21] Appl. No.: 348,689

[22] Filed: Nov. 30, 1994

[51] Int. Cl.[6] ..... B05B 1/08

[52] U.S. Cl. ..... 239/101

[58] Field of Search ..... 239/101, 99, 548, 239/543

[56] References Cited

U.S. PATENT DOCUMENTS

| | | | |
|---|---|---|---|
| 3,423,026 | 1/1969 | Carpenter | 239/101 X |
| 3,507,275 | 4/1970 | Walker | 239/101 |
| 3,628,726 | 12/1971 | Johnson | 239/101 |

FOREIGN PATENT DOCUMENTS

| | | | |
|---|---|---|---|
| 1168143 | 7/1985 | U.S.S.R. | 239/101 |

*Primary Examiner*—Kevin Weldon
*Attorney, Agent, or Firm*—James B. Bechtel, Esq.

[57] ABSTRACT

A fluid disperser is provided for dispersing a first fluid into a moving stream of a second fluid. After the first fluid is pressurized to at least twice the pressure of the second fluid, the first fluid is passed through a throat that increases the flow velocity of the first fluid to supersonic. A fluidic oscillator, coupled to the output of the throat, has a central axis of symmetry, a first end by which the first fluid enters the oscillator and a second end by which the first fluid exits the oscillator. The oscillator includes two opposing walls that diverge symmetrically about the central axis from the first to the second end at an angle of divergence relative to the central axis that causes the first fluid entering the first end to attach to either of the two opposing walls and continue therealong to the second end. The oscillator further includes feedback loops for feeding back a portion of the first fluid exiting the second end that is attached to either of the two opposing walls to the first end so that the first fluid will detach from one of the two opposing walls and attach to the other of the two opposing walls. First and second diverging nozzles, coupled to the second end of the oscillator, direct a remainder of the first fluid exiting the second end into the second fluid. specifically, each of the first and second diverging nozzles diverge symmetrically about and away from the central axis at approximately the angle of divergence. The first and second diverging nozzles terminate in a spaced apart relationship in the second fluid.

14 Claims, 1 Drawing Sheet

SUPERSONIC FLUID DISPERSING INJECTOR

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to fuel injectors, and more particularly to a supersonic fluid dispersing injector useful for dispersing a fluidic (i.e., atomized liquid or gas) fuel into a moving air stream.

BACKGROUND OF THE INVENTION

Liquid fuels are generally atomized prior to being injected into an air stream within an engine's combustion chamber. Gaseous fuels are introduced into an engine by using jets which continuously spray the fuel into an air stream. In either case, when the air stream is moving at high speed (e.g., hundreds or even thousands of feet per second), it is imperative that the fuel be mixed or dispersed in the air stream as quickly and efficiently as possible. However, when introduced as a continuous stream of liquid droplets or small gas volumes, a certain amount of time must be allowed for the fuel to mix with the moving air into which it is injected. However, the time delay associated with the mixing process makes for an inefficient combustion system. Thus, if the stream of introduced fuel can be dispersed homogeneously and quickly into the air stream, the efficiency of the engine can be increased.

SUMMARY OF THE INVENTION

Accordingly, it is an object of the present invention to provide a fluid disperser capable of dispersing a fluid into a moving air stream.

Another object of the present invention is a fluid disperser that produces and mixes small droplets of an atomized liquid fuel or small volumes of a gaseous fuel into a fast moving air stream.

Other objects and advantages of the present invention will become more obvious hereinafter in the specification and drawings.

In accordance with the present invention, a fluid disperser is provided for dispersing a first fluid into a moving stream of a second fluid. A pressure source pressurizes the first fluid to at least twice the pressure of the second fluid. A throat coupled to the pressure source receives the first fluid from the pressure source to increase the flow velocity of the first fluid to a supersonic flow velocity. A fluidic oscillator is coupled to the output of the throat. The oscillator has a central axis of symmetry and a first end by which the first fluid enters the oscillator and a second end by which the first fluid exits the oscillator. The oscillator includes two opposing walls that diverge symmetrically about the central axis from the first to the second end at an angle of divergence relative to the central axis that causes the first fluid entering the first end to attach to either of the two opposing walls and continue therealong to the second end. The oscillator further includes feedback loops for feeding back a portion of the first fluid exiting the second end that is attached to either of the two opposing walls to the first end so that the first fluid will detach from one of the two opposing walls and attach to the other of the two opposing walls. First and second diverging nozzles are also coupled to the second end of the oscillator to direct a remainder of the first fluid exiting the second end into the second fluid. Each of the first and second diverging nozzles diverge symmetrically about and away from the central axis at approximately the angle of divergence. The first and second diverging nozzles terminate in a spaced apart relationship in the second fluid.

DETAILED DESCRIPTION OF THE INVENTION

Figure 1:
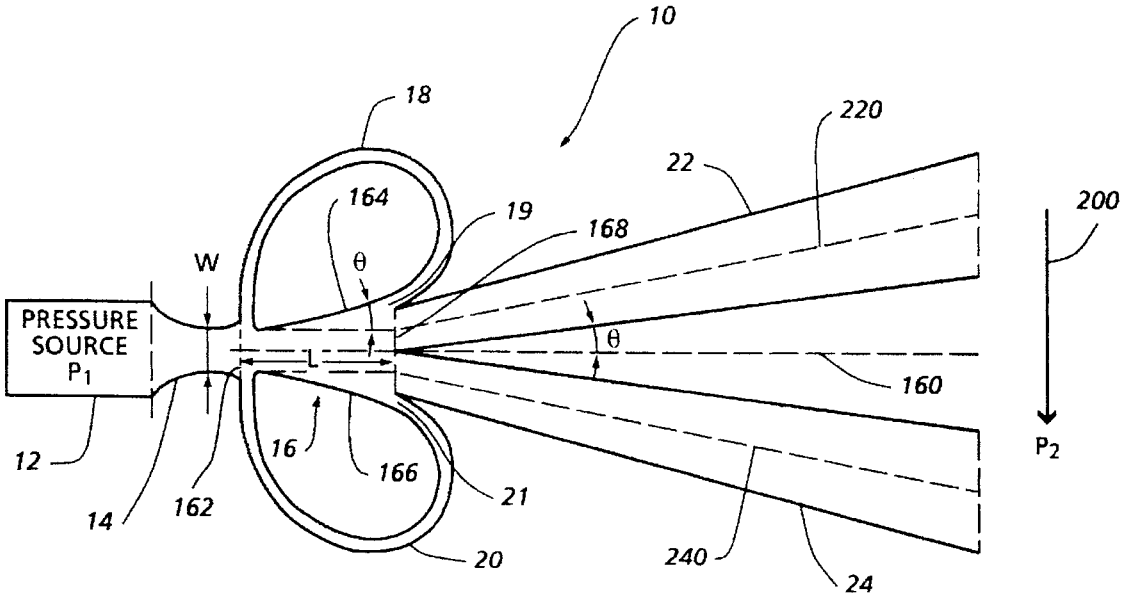
FIG. 1 is a plan view of the fluid disperser according to the present invention.

Referring now to the drawings, and more particularly to FIG. 1, a schematic plan view is shown of fluid disperser 10 according to the present invention. Vertical dashed lines are used to separate the serially connected elements that comprise fluid disperser 10. Structurally, pressure source 12 feeds throat 14 which empties into chamber 16 at inlet opening 162. Chamber 16 is defined by opposing walls 162 and 164 that diverge from one another about central longitudinal axis 160 along the length of chamber 16. Feedback loops 18 and 20 are connected to the downstream opening 168 of chamber 16 along respective opposing walls 164 and 166. Feedback loops 18 and 20 are fed back and connected to chamber 16 adjacent inlet opening 162 along respective opposing walls 164 and 166. Finally, extending from downstream opening 168 are diverging nozzles 22 and 24 which terminate/empty into a moving fluid stream (e.g., air stream) represented by the arrow referenced by numeral 200. Fluid disperser 10 can be fabricated in any one of a variety of manners well known in the art. Relevant dimensions and parameters indicated in FIG. 1 are throat width W at the narrowest or minimal area portion of throat 14, angle of divergence θ for opposing walls 162 and 166 relative to central longitudinal axis 160, length L of chamber 16 along central longitudinal axis 160, pressure $P_1$ of the fluid to be dispersed as pressurized by pressure source 12, and pressure $P_2$ of moving fluid stream 200. For purpose of description and ease of fabrication, it will be assumed that the flow elements of fluid disperser 10, namely, throat 14, chamber 16, feedback loops 18 and 20, and nozzles 22 and 24, are of a constant depth (i.e., into the paper) on the order of 1 millimeter.

By way of example, operation of the present invention will now be described in terms of dispersing a gas into moving air stream 200. However, it is to be understood that the following description applies equally as well to the dispersing of an atomized liquid. In accordance with standard compressible fluid mechanics, the gas is first pressurized by pressure source 12 to a pressure $P_1$ that is at least twice as great as $P_2$, i.e., the pressure of moving air stream 200, in order to achieve a supersonic flow following throat 14. However, as will be shown further below, $P_1$ has an upper limit for the present invention that is approximately 3.5–4 times that of $P_2$.

The pressurized gas is allowed to escape through throat 14 which is sized as is well known in the art in terms of its width W to generate a supersonic velocity as the gas exits throat 14. Angle of divergence θ is selected so that as the high-speed gas exits throat 14 and enters chamber 16, the Coanda effect causes the gas to attach to either of opposing walls 164 or 166 as it moves through chamber 16 toward downstream opening 168. For the supersonic flow velocities developed by throat 14, an angle of divergence of $\theta \approx 15°$ was found experimentally to provide the best results. Because of the Coanda effect and because the beginning of each of feedback loops 18 and 20 is in line with a respective one of opposing walls 164 and 166, some of the gas exiting downstream opening 168 is siphoned off by the appropriate one of feedback loops 18 or 20 and returned to throat 14. The remainder of the gas proceeds through downstream opening 168 into the appropriate one of diverging nozzles 22 or 24.

Figure 2:
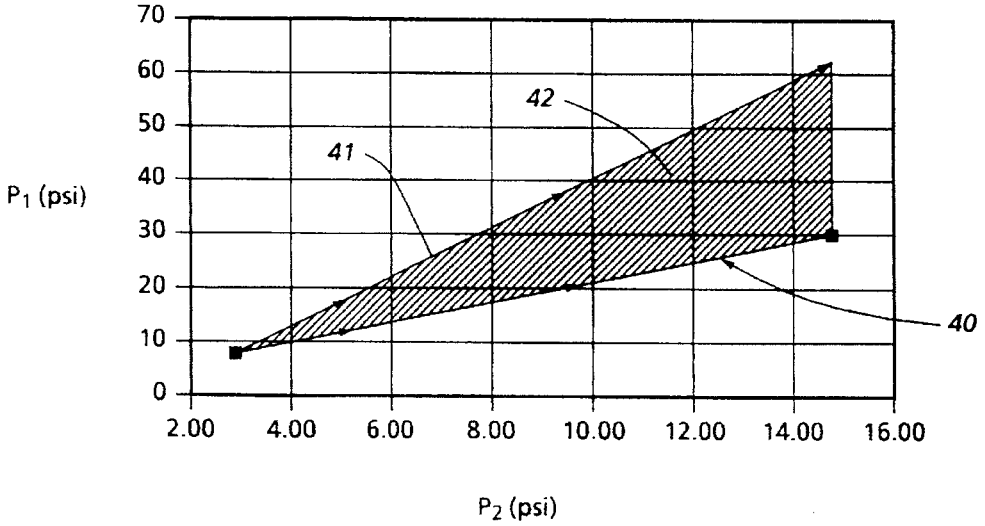
FIG. 2 is a graph of the oscillation range of the present invention as dictated by the pressure relationship between the pressure $P_2$ of the moving stream and the pressure $P_1$ of the gas to be dispersed.

For purpose of explanation, it will be assumed that the gas flow first attaches to wall 164. Thus, the gas is fed back by the feedback loop 18. The gas in feedback loop 18 (or feedback loop 20) will be referred to hereinafter as return gas. The momentum of the return gas entering chamber 16 adjacent inlet opening 162 causes the gas flow entering chamber 16 to detach from wall 164. Since angle of divergence $\theta$ is identical for both opposing walls 164 and 166, the gas flow will now attach itself to wall 166. The gas will flow along wall 166 to downstream opening 168 where the return gas to inlet chamber 16 now is supplied by feedback loop 20 to cause the gas flow entering inlet chamber 16 to detach from wall 166 and re-attach to wall 164. Thus, chamber 16 along with feedback loops 18 and 20 comprise a fluidic oscillator. To insure that there is sufficient momentum to cause the flow to detach from its attached wall, the width of each entryway 19 and 21 of respective feedback loops 18 and 20 is about ⅓ of the width of respective nozzles 22 and 24 at downstream opening 168. Thus, about 25% of the gas attached to wall 164 (i.e., directed towards nozzle 22) is fed back to chamber 16 via feedback loop 18. Similarly, about 25% of the gas attached to wall 166 (i.e., directed towards nozzle 24) is fed back to chamber 16 via feedback loop 20. The length of chamber 16 from inlet opening 162 to downstream opening 168 along central longitudinal axis 160 is 8 to 10 times throat width W. For a throat width W of 1 millimeter, the present invention provided oscillating dispersion of the pressurized gas in accordance with the graph of FIG. 2. In FIG. 2, curve trace 40 represents the lower limit of $P_1$ for a given $P_2$ for which oscillation will occur. Curve trace 41 represents the upper limit of $P_1$ for a given $P_2$ for which oscillation will occur. Thus, hatched region 42 represents the oscillation range.

As described above, the gas exiting downstream opening 168 that is not siphoned off into one of feedback loops 18 or 20 flows into the appropriate one of diverging nozzles 22 or 24. The high-frequency oscillation brought about by chamber 16 with feedback loops 18 and 20 means that the gas entering either of diverging nozzles 22 and 24 will occur in very short bursts. These bursts of gas are directed by the diverging nozzles into moving air stream 200 at two spaced apart locations. The combination of short bursts of gas at two spaced apart locations enhances the mixing of the gas into moving air stream 200. The frequency of oscillation is independent of pressure, but is dependent on the length of feedback loops 18 and 20 and the molecular weight of the gas being dispersed. In particular, the frequency of oscillation decreases as the length of a feedback loop increases and a lower molecular weight gas provides higher frequency of oscillation.

So as not to disturb the supersonic flow of the gas exiting chamber 16, the respective central longitudinal axes 220 and 240 of diverging nozzles 22 and 24 are angularly spaced from central longitudinal axis 160 by the same angle as angle of divergence $\theta$. Further, the divergent nature of each of diverging nozzles 22 and 24 assures that the supersonic flow of the gas will not be disturbed. The amount of divergence of each of nozzles 22 and 24 relative to the respective longitudinal axes 220 and 224 is on the order of 5° or less.

The advantages of the present invention are numerous. The fluid disperser enhances mixing of fluids (gases or atomized liquids) that must be mixed into another fluid. Experiments have shown that when the flow of the fluid moving through the disperser is supersonic, the oscillation frequency at the output is constant thereby providing a consistent mix of the dispersed fluid. Thus, the present invention can be used to augment the dispersal of a fuel into a moving stream of air in an engine such as a ramjet, scramjet, or turbojet engine where the air stream is moving at very high speeds and the fuel must be dispersed quickly and homogeneously into the air stream. The present invention would also find utility in automobile fuel injection systems.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. An apparatus for dispersing a first fluid moving with a supersonic flow velocity into a moving stream of a second fluid comprising:

an inlet chamber having a central axis of symmetry and having a first end by which said first fluid enters said inlet chamber and a second end by which said first fluid exits said inlet chamber, said inlet chamber defined by two opposing walls that diverge symmetrically about said central axis of symmetry from said first end to said second end at an angle of divergence relative to said central axis of symmetry that causes said first fluid entering said first end to attach to either of said two opposing walls and continue therealong to said second end;

feedback control means coupled between said first end and said second end of said inlet chamber, said feedback control means feeding back a portion of said first fluid attached to either of said two opposing walls to said first end so that said first fluid will detach from one of said two opposing walls and attach to the other of said two opposing walls; and first and second diverging nozzles having a diverging outlet coupled to said second end of said inlet chamber for directing a remainder of said first fluid attached to either of said two opposing walls into said second fluid, said first and second diverging nozzles disposed symmetrically about said central axis of symmetry, each of said first and second diverging nozzles extending away from said central axis of symmetry at approximately said angle of divergence, said first and second diverging nozzles terminating in a spaced apart relationship in said second fluid.

2. An apparatus as in claim 1 wherein said angle of divergence is approximately 15°.

3. An apparatus as in claim 1 further comprising:

a pressure source for pressurizing said first fluid to at least twice the pressure of said second fluid; and a throat coupled between said pressure source and said first end of said inlet chamber for receiving said first fluid from said pressure source and for outputting said first fluid at said supersonic flow velocity.

4. An apparatus as in claim 3 wherein said throat has a width W at its narrowest portion, and wherein said inlet chamber has a length along said central axis of symmetry that is approximately 8–10 times said width W.

5. An apparatus as in claim 1 wherein said feedback control means comprises:

a first feedback loop coupled to said inlet chamber between locations along one of said two opposing walls at said first end and said second end; and a second feedback loop coupled to said inlet chamber between locations along the other of said two opposing walls at said first end and said second end.

6. An apparatus as in claim 1 wherein said portion is approximately 25% of said first fluid attached to either of said two opposing walls.

7. An apparatus for dispersing a first fluid into a moving stream of a second fluid comprising:

a pressure source for pressurizing said first fluid to a pressure that is approximately in the range of 2–4 times the pressure of said second fluid;

a throat coupled to said pressure source for receiving said first fluid from said pressure source and for outputting said first fluid at a supersonic flow velocity;

a fluidic oscillator having a central axis of symmetry and having a first end by which said first fluid enters said fluidic oscillator and a second end by which said first fluid exits said fluidic oscillator, said fluidic oscillator including two opposing walls that diverge symmetrically about said central axis of symmetry from said first end to said second end at an angle of divergence relative to said central axis of symmetry that causes said first fluid entering said first end to attach to either of said two opposing walls and continue therealong to said second end, said fluidic oscillator further including means for feeding back approximately 25% of said first fluid exiting said second end and attached to either of said two opposing walls to said first end so that said first fluid will detach from one of said two opposing walls and attach to the other of said two opposing walls; and first and second diverging nozzles coupled to said second end of said fluidic oscillator for directing approximately 75% of said first fluid attached to either of said two opposing walls into said second fluid, each of said first and second diverging nozzles diverging symmetrically about and away from said central axis of symmetry at approximately said angle of divergence, said first and second diverging nozzles terminating in a spaced apart relationship in said second fluid.

8. An apparatus as in claim 7 wherein said angle of divergence is approximately 15°.

9. An apparatus as in claim 7 wherein said throat has a width W at its narrowest portion, and wherein said fluidic oscillator has a length along said axis of symmetry that is approximately 8–10 times said width W.

10. An apparatus for dispersing a first fluid moving with a supersonic flow velocity into a moving stream of a second fluid comprising:

an inlet chamber having a central axis of symmetry and having a first end and a second end, said inlet chamber defined by two opposing walls that diverge symmetrically about said central axis of symmetry from said first end to said second end at an angle of divergence relative to said central axis of symmetry;

a first feedback loop coupled on one end thereof to said second end of said inlet chamber at one of said two opposing walls, said first feedback loop extending away from said second end of said inlet chamber at said angle of divergence prior to being shaped towards said first end of said inlet chamber, said first feedback loop further coupled on another end thereof to said first end of said inlet chamber;

a second feedback loop coupled on one end thereof to said second end of said inlet chamber at another of said two opposing walls, said second feedback loop extending away from said second end of said inlet chamber at said angle of divergence prior to being shaped towards said first end of said inlet chamber, said second feedback loop further coupled on another end thereof to said first end of said inlet chamber, wherein said another end of said first feedback loop and said another end of said second feedback loop oppose one another at said first end of said inlet chamber; and first and second diverging nozzles coupled to said second end of said inlet chamber between said one end of said first feedback loop and said one end of said second feedback loop, said first and second diverging nozzles disposed symmetrically about said central axis of symmetry, each of said first and second diverging nozzles extending away from said central axis of symmetry at said angle of divergence, said first and second diverging nozzles terminating in a spaced apart relationship in said second fluid.

11. An apparatus as in claim 10 wherein said angle of divergence is approximately 15°.

12. An apparatus as in claim 10 further comprising:

a pressure source for pressurizing said first fluid to at least twice the pressure of said second fluid; and a throat coupled between said pressure source and said first end of said inlet chamber for receiving said first fluid from said pressure source and for outputting said first fluid at said supersonic flow velocity.

13. An apparatus as in claim 12 wherein said throat has a width W at its narrowest portion, and wherein said inlet chamber has a length along said central axis of symmetry that is approximately 8–10 times said width W.

14. An apparatus as in claim 10 wherein each of said first and second diverging nozzles has a longitudinal axis, wherein the amount of divergence relative to said longitudinal axis for each of said first and second diverging nozzles is approximately 5°.

* * * * *